US007087866B2

(12) United States Patent
de Los Toyos et al.

(10) Patent No.: US 7,087,866 B2
(45) Date of Patent: Aug. 8, 2006

(54) RADIANT HEATER IN A COOKING HOB WITH A THERMAL SWITCH

(75) Inventors: Daniel de Los Toyos, Eibar (ES); Jon Endika Azpiritxaga, Durango (ES)

(73) Assignee: Eika, S. Coop., Etxbarria (ES)

( * ) Notice: Subject to any disclaimer, the term of this patent is extended or adjusted under 35 U.S.C. 154(b) by 0 days.

(21) Appl. No.: 10/965,924

(22) Filed: Oct. 14, 2004

(65) Prior Publication Data

US 2005/0274710 A1 Dec. 15, 2005

(30) Foreign Application Priority Data

Jun. 14, 2004 (ES) ..... 200401433 U

(51) Int. Cl.
*H05B 3/68* (2006.01)
*H01H 37/32* (2006.01)

(52) U.S. Cl. ..... 219/448.11; 219/448.16; 219/460.1; 337/333

(58) Field of Classification Search ..... 219/446.1, 219/447.1, 448.11, 448.12, 448.14, 448.16, 219/448.17, 448.18, 460.1, 461.1, 462.1, 219/463.1; 337/333, 334, 342, 343, 362–365
See application file for complete search history.

(56) References Cited

U.S. PATENT DOCUMENTS 4,059,817 A * 11/1977 Hollweck et al. ..... 337/365
4,791,397 A * 12/1988 Wells ..... 337/354
6,121,587 A * 9/2000 Leiprecht et al. ..... 219/448.16
6,756,569 B1 * 6/2004 Bates et al. ..... 219/461.1

* cited by examiner

*Primary Examiner*—Sang Y. Paik
(74) *Attorney, Agent, or Firm*—The Kline Law Firm

(57) ABSTRACT

The electric radiant heater (1) adapted to a cooking hob is attached to the cooking plate (2*a*) forming with it an air cavity (13) inside which the extended heating resistor (5) is housed on an insulating base (4). A peripheral insulating ring (6) and an outer metal tray form a peripheral external wall (3,6) defining said cavity (13) in which there is positioned a bimetal thermal switch (7), which has a compact body (7*a*) resting on the surface (4*a*) of the insulating base, and a heat receiver base (7*b*) in a position facing a part of the heating resistor (5). The position of the compact body (7*a*) relative to the heating resistor (5) is determined so as to obtain an actuating temperature point (SWC, SWO) adjusted for switching a hotplate warning light on and off.

5 Claims, 2 Drawing Sheets

RADIANT HEATER IN A COOKING HOB WITH A THERMAL SWITCH

TECHNICAL FIELD

The present invention is related to a radiant heater for an electric cooking hob, provided with a thermal switch for turning on and off a warning lamp to indicate the state of the hot plate during heating and cooling.

PRIOR ART

Radiant heaters of the above-mentioned type are known, with a built-in thermal switch whose electrical contact is used for switching on a warning lamp indicating that the cooking plate is still "hot" with a hazardous residual temperature, the threshold of which is set at 60 –70° C. The thermal switch has to switch the warning contact during the onset of the heating of the cooking plate as well as during cooling to warn of a residual temperature higher than the aforesaid threshold value. The bimetallic sensor does not make direct contact with the hot plate, but the switch response time should be correlated to the actual temperature of the plate. For this purpose the thermal switch is situated on an area of the heater to receive proportionally the heat transmitted to the plate so that the value reached in the sensing element, always higher than on the plate, closely follows the changes in said real value. The switch actuating point is set at a suitable temperature point for switching in both plate heating and cooling directions, taking into account also the thermal hysteresis of the switch, which leads to a lower switching point during cooling.

Detecting the residual cooking plate temperature by means of a bimetallic sensor separated from the plate itself, as in the prior art solutions, presents the problem of the influence of the heat transmitted from adjoining heaters, which raises the ambient temperature and heats the peripheral wall of the heater. This problem is particularly evident in the case of the so-called "warmer" type radiant heater, which is used solely for warming precooked foods or holding them at the maximum plate temperature of around 300° C. The power of the heater is low compared with the adjoining cooking heaters of the same hob, which heat their respective hob area up to 550° C. For this reason the cover or metal support tray that encircles the heater, ends up hot due to the transmission of the adjoining heaters switched on at the same time. The problem of the temperature in the outer wall of the heater becomes critical when the ceramic body of the bimetallic sensor is submitted directly to heating from the adjoining heaters, so that the sensitive disc of the bimetallic switch may reach a temperature of around 100° C., and it loses correlation with the actual temperature of the plate area it has to detect. Alternatively, the outer heating of the built-in bimetallic switch may come from heat sources below the heater.

In the known solutions, for example that disclosed in DE-A- 2627373, the thermal switch for turning on the warning lamp is fixed at the peripheral edge of the heater and for its operation it has an expanding rod coupled to the heating resistors from which it receives heat.

In U.S. Pat. No. 6,121,587 a second bimetallic switch built into the radiant heater operates at a temperature of less than 35 100° C. to indicate residual heat and is disposed in an air duct built into the insulating outer wall of the heater, so that no expanding rod is needed for its actuation. But attached to the sensitive element this sensor has an additional heat transmitting member that receives the radiation of the heating resistors in order to obtain a quick response of the heat sensitive element of the cooking plate. Owing to the influence of external heating on the sensor, the bimetal disc does not follow the variation in the late area heated closely, and it therefore requires a high adjusting point for actuating the switching contact, well separated from the maximum warning threshold value of 80° C. at the hot plate.

Publication US-2002/0185489-A1 describes a radiant heater only for warming or "warmer", which uses a bimetallic switch for turning on a "hot" plate warning lamp. The sensor is built into the heater secured between the peripheral insulating ring and the horizontal base of the heater, in a hole space shaped to the outline of the body of the sensor. Owing to the fact that the ceramic body has no heat insulation against the transmission of external heat, the bimetallic disc may reach a temperature of more than 100° C., even when the heater if off. Therefore, while the heater plate area is cooling, the temperature detected at the bimetallic sensor follows an almost asymptotic slope above 100° C. (represented by the dotted line in FIG. 4) and the response time of the sensor in opening the electrical contact is very long and out of touch. When the adjacent heaters are off, the sensor bimetallic disc reaches a temperature 40° C. lower than in the other case. It is thus hard to find a setting point for the switching of the electrical contact in both directions. Further, one certain point of actuation of the sensor being set, after adding the differential interval due to the actual switching hysteresis of the switch, the temperature difference in the plate area, the difference between the moment of closure and the moment of opening, may reach as much as 70° C., even larger than an acceptable signalling interval of 50 –80° C.

The type of thermal switch or bimetallic sensor used in the heaters in the prior art are of the type described in U.S. Pat. No. 4,059,817, provided with a cylindrical sensor body and a heat receiving metallic base in direct contact with the internal bimetallic temperature-sensitive disc. Another type of known bimetallic thermal switch with a built-in radiant heater is described in publication DE-1123059-A and it is also compact with a ceramic body whose heat-receiving side presents a recess through which a bimetallic plate is deformed, while the terminals are situated on the opposite side of the body, facing longitudinally.

DISCLOSURE OF THE INVENTION

The object of the present invention is an electric radiant heater adapted to a cooking hob provided with a top heating plate and various radiant heaters, which has a built-in thermal switch including a bimetal sensing element sensitive to a temperature of the radiant heater, for switching a hot plate warning lamp on and off above and below a residual temperature threshold value in the heated plate area.

The thermal sensing switch is fixed inside the heater separate from the cooking plate, isolated there from the influence of the adjacent heaters of the cooking hob. The temperature value detected is faithfully correlated to the true value in the heated plate area, both during heating and during cooling. Thereof the actuation of the switch is thereby achieved in both directions within an acceptable residual temperature range in the plate area of 65°±15

The preferably bimetal type thermal switch is disposed in an air cavity within the heater under the cooking plate, wherein the heating resistors are mounted. In one embodiment of the invention the type of thermal switch used is a compact body bimetal sensor whose heat receiving side for the sensing element is directly facing the radiation of the heating resistors. Positioned in this way, the bimetal sensor is isolated from the influence of the external heating produced by the adjacent cooking heaters switched on at the same time. A quick sensor response to plate heating is also achieved as well as precise temperature detection during cooling, closely correlated to the real value in the heated plate area. The response time to cooling is not delayed unnecessarily, due to the fact that the bimetallic sensor is isolated from the metal cover of the present heater, through the interposition of the peripheral isolating wall thereof, and its air cavity in which the sensor is enclosed inside the heater.

The radiant heater according to the invention does not use additional fixing means either for the bimetallic sensor, since it is situated up against a surface of the heating resistor insulating carrier or base. The sensor is secured and pressed here by the elastic force of rigid electrical connection cables. In this way, its position relative to the heating resistors is fixed and does not vary either moved by the thermal constraints in the sensor body.

DETAILED DESCRIPTION OF THE INVENTION

Figure 2:
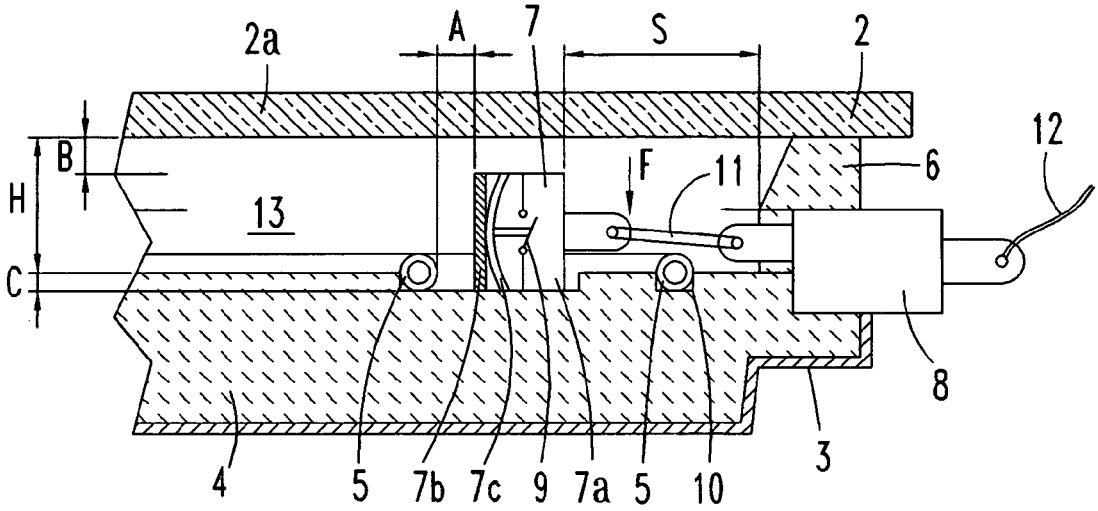
FIG. 2 is a partial sectional view of the radiant heater under the cooking plate according to line II—II in FIG. 1.

In reference to FIGS. 1–3, a preferred embodiment of radiant heater 1 is attached to the heating plate 2 of a cooking hob with various radiant heaters next to one another (not shown in the drawings) and it is made up of a cover or metal tray 3, an insulating base 4 carrying the heating resistors 5, a peripheral insulating ring 6 in contact with the cooking plate, a compact thermal switch or bimetal sensor 7 disposed in an air cavity 13 formed below the heated plate area 2*a*, between the insulating base 4 and the insulating ring 6, and an electrical connector 8 that transmits the power to the heating resistors 5 directly.

The bimetallic sensor 7 has a compact electrical insulating body 7*a*, with an external metal base 7*b* on one side, which is exposed to direct radiation from at least one heating resistor 5, and a temperature-sensitive bimetal disc 7*c* housed in the receiver side of the body 7*a*, which actuates an electrical contact 9 of the normally open sensor, whose closure switches on a warning lamp (not shown in the drawings) of the residual temperature in the plate area 5*a* on the heater. The heating resistors 5 may be the flat strip or coiled wire type, and they are installed on the surface of the insulation base 4, e.g. guided in a groove 10. The power of the "warming heater" described here as an example is 250 W, normally less than the power of the adjacent 750 –1250 W cooking heaters.

The bimetallic sensor 7 is disposed in the air cavity 13, resting on the surface of the insulating base 4, with the metal base 7*b* facing one of the resistors 5, at a separation distance "A" there from. The height "H" of the cavity 5 is, as in other heaters, the standard one of 20 –25 mm. The body 7*a* of the bimetallic sensor is preferably square section so as to attain stable support on the insulation base 4. The metal base 7*b* is thereby in a vertical position facing the resistor 5, in direct contact with the bimetal disc 7*c*, since a commercial sensor model is chosen for economic cost reasons. The metal base 7*b* of the sensor may be flat, as is shown in the FIGS. 1 and 2, or double square above the resistor 5, in order to enhance the reception of radiation at the metal base 7*b*. The shape of the metal base 7*b* is adapted so that its receiving surface acquires a height "D" (FIG. 3) from the protruding part of the resistor 5 by means of increasing the depth "C" of the body support recess 4*a* in the insulation base.

The sensor body 7*a* is isolated from the external thermal influence, being set apart from the insulating ring 6 by a separating space "S" (FIG. 2), the size of which depends on the distribution of the heating resistors 5 and on their coil configuration, and it is determined by finding a suitable setting point of the switch 9 in the two switching directions. The body of the sensor 7*a* is situated between two resistors 5, as is shown in FIG. 1, or else with the metal base 7*b* of the sensor at a separation distance "A" from a portion of peripheral resistor 5.

Other compact thermal switch models 7 of the bimetal type may be used instead of the above-described sensor with a receiving metal base 7*b*, with the side of the sensor body 7*a* where the sensing element is housed facing the heating resistor 5, and with the electrical terminals issuing from the opposite side.

Between the plate 5 and the bimetal sensor 7 there has to be a separating space "B", because of cooking plate is considered an electrical conductor when heated. A space "B" of at least 3 mm is chosen, so the centre of the bimetal disc 7*c* is brought closer to the resistor 5 so as to improve radiation transmission. For the same purpose the sensor 7*a* body support surface is moulded in the form of a recess 4*a* of the same or greater depth "C" than the guide groove 10. Besides facilitating the installation of the sensor 7, this support also prevents later displacements.

The electrical contact 9 of the sensor is joined by two rigid cables 11 to the peripheral electrical connector 8, from which the warning lamp is switched on by way of a line 12. Following the objective of retaining in position the bimetallic sensor within the heater, the elasticity of the metal cables 11 extended with a small angle of inclination produces a force "F" applied to the sensor body 7*a* against the support surface 4*a*. The position of the sensor 7 is thus held fixed against the movements caused by the thermal constraints. Instead of using rigid intermediate connection cables 11, the sensor body 7*a* may be retained by means of the direct connection of the rigid output terminals 11 of contact 9 to the rigid terminal of electrical connector 8.

Figure 1:
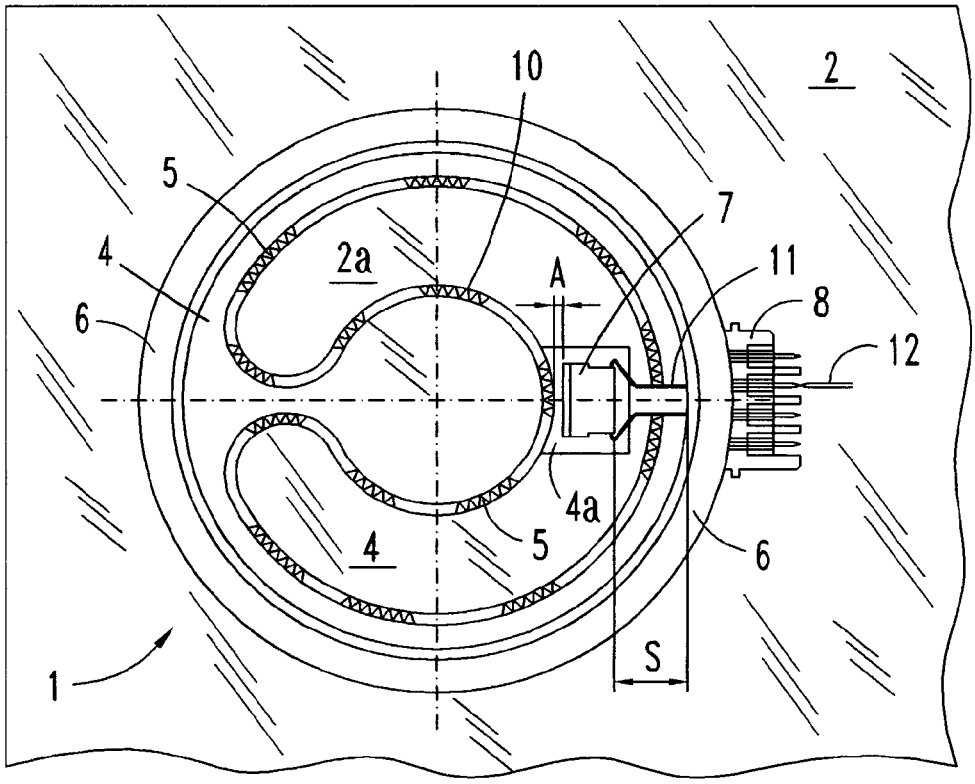
FIG. 1 is a plan view of a radiant electric heater adapted to a cooking plate, with a built-in thermal warning lamp switch.
Figure 3:
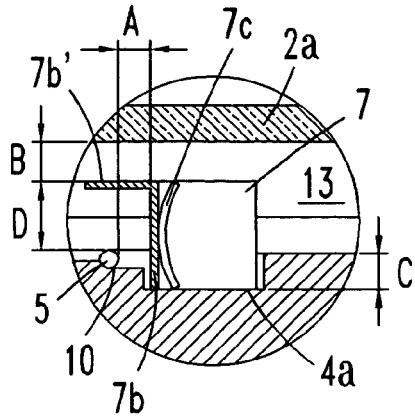
FIG. 3 is a close view of the radiant heater in FIG. 1 compared with the temperature measurement in the bimetal sensor.
Figure 4:
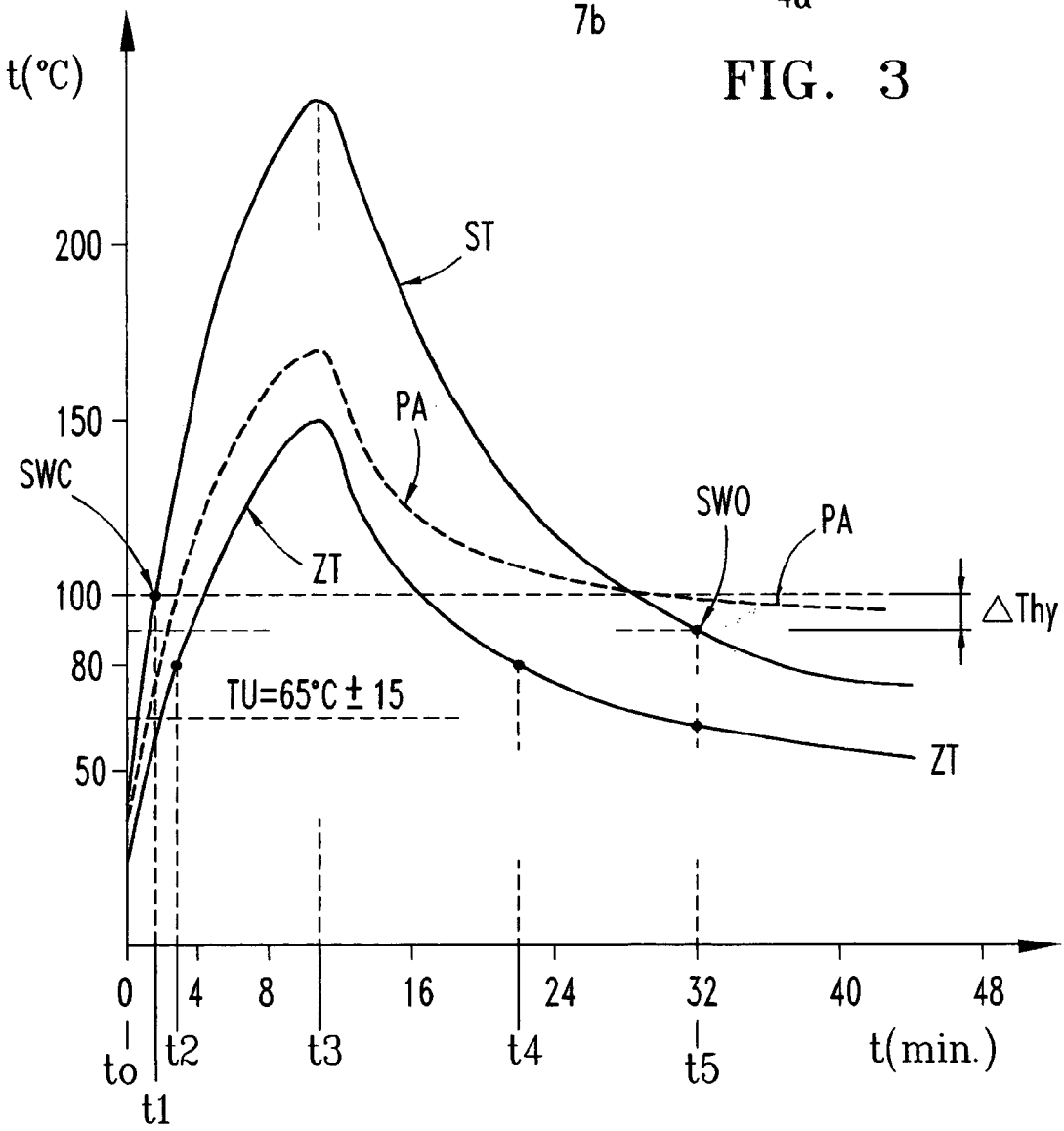
FIG. 4 is a diagram of the resultant temperature in the cooking plate area of FIG. 1 compared with the temperature measurement at the bimetallic sensor.

In a temperature (T)/time (t) diagram FIG. 4 shows the results of the real measurement at plate 2*a*, represented by curve ZT, and of the temperature detected by the bimetal sensor 7, represented by curve ST, wherein the bimetallic sensor 7 has been positioned as described and shown in the embodiment of FIGS. 1–2. Curve PA represents the evolution of the temperature in the bimetal sensor in a prior art heater. The curves in FIG. 4 are plotted with the real temperature values "T" measured in a heating and cooling test of the plate area 2*a* on the heater, which has reached around 150° C. in the process with a food container, and in a more unfavourable case for a suitable setting of the switching point of contact 9 to be found in both directions, which occurs under the influence of the adjacent cooking heaters that are also working at the same time.

The moments of time t0 to t5 marked in the diagram in FIG. 4 refer to: t0: heater ON; t1: the plate 2*a* rises up to the value of the warning temperature TU=65°±15; t2: closure switching of the electrical contact 9; t3: heater OFF; t4: plate 2*a* drops down to the value of the warning temperature TU=65° C.±15; t5: opening switching of the electrical contact 9.

In the example described in FIG. 4 a value was found of around 100° C. for the setting of the switching point SWC-SWO of the switch 9, which is suitable in both directions. As the temperature rises, at switching moment "t2" it turns on the warning lamp at an SWC temperature point, for example of 100° C., without delay in respect of the rated TU of 65° C. in the area of plate 2*a*, whereas at switching moment "t5", as the temperature drops, contact 9 is open at an SWO temperature point for instance of 90° C., to turn off the warning lamp, including the interval ΔThy=10° C. due to the hysteresis effect in the actual cooling of a bimetallic switch. With regard to the moment "t4" of dropping to the maximum permissible temperature TU (max)=80° C. of the plate, the time delay t5–t4 without the lamp being switched off is acceptable by the user, around 10 minutes.

In reference to curve PA in FIG. 4 corresponding to the prior art heater, the bimetallic sensor is inserted in the peripheral wall of the heater. Due to its indirect warming from the adjoining cooking heaters, the sensor does not detect the variation in temperature of the plate area below 100° C. during cooling, so the switch has to be set at a very high opening point in relation to the highest plate temperature TU (max)=80° C. permissible, or otherwise the switch delay, moment "t5", may be protracted indefinitely, including when the plate temperature "ZT" has dropped below the minimum threshold value "TU (min)"=50° C. In the prior art example, the differential interval obtained in the plate area between both responses to heating and cooling may be as large as 70° C., a long way outside the permissible range TU=65°±15.

With the arrangement of the bimetallic sensor 7 according to the invention, a differential interval smaller than 40° C. is attained between the two ZT values at the plate, referring to the moments "t1" of closure and "t5" of opening of switch 9, which matches up with a rated actuating interval of TU=65°±15, the body of the sensor 7*a* being fixed in the heater cavity 13 and in a position "A" relative to one of the heating resistors, and separated by a space "S" from the peripheral insulating wall 6, as well as a space "B" from the cooking plate for its electrical insulation.

The invention claimed is:

1. An electric radiant heater adapted to a cooking hob with a top heater plate and radiant heaters, comprising:

a substantially flat insulating base parallel to the top plate (2) and a heating resistor (5) extended over the surface of the insulating base (4) according to a given geometric configuration, a peripheral insulating ring wall (6) in contact with the cooking plate (2), and an outer cover or metal tray (3) forming a peripheral outer wall (3,6) of the radiant heater together with said insulating ring, a bimetal type thermal switch (7) incorporated within the radiant heater, and an electrical power connector (8) fixed in said peripheral wall (3,6), wherein said peripheral wall (3,6) of the radiant heater (1) defines a heated plate area (2*a*) and below it forms an air cavity (13) along with the flat insulating base (4) and said thermal switch (7) having a compact body (7*a*) of heat-resistant insulating, material is retained in a given position (A,B,D,S) inside said air cavity (13), said compact body (7*a*) and terminals (11) resting on a central surface (4*a*) of the insulating base such that said thermal switch (7) is thermally isolated from said peripheral wall (3,6), and wherein a bimetal element (7*c*) is facing towards heat radiation from at least one portion of the heating resistor (5) for the detection of a temperature value (ST) correlated to an actual temperature (ZT) within a defined warning range (TV) of the plate area (2*a*) during both heating up and cooling down processes of said radiant heater, wherein the bimetallic switch (7), receiving the heat radiation directly from said at least one portion of the heating resistor (5), has an electrical contact (9) which is set at an actuation point (SWC, SWO) for the switching of a warning indication of the condition "hotplate", and wherein said heat radiation is transmitted by way of a receiver base (7*b*) in the sensor compact body made of thermal conductor material (7*b*), which is positioned opposite and close to said at least one portion of the heating resistor (5), separated from the heating resistor (5) by an intermediate space (A) which is determined in order to obtain a suitable actuation point (SWC, SWO) for actuating the electrical contact (9).

2. The electrical radiant heater according to claim 1, wherein said thermal switch body (7*a*) fixed in said air cavity (13) by resting on said central surface of the insulating base (4*a*), has a heat radiation receiver base (7*b*) in a position facing a raised portion of the heating resistor (5), and separated from the latter by a given space "A", and the receiver base (7*b*) extends up to a given height (D) relative to the insulating base (4) greater than the heating resistor (5), whereby said temperature value (ST) correlated to the actual temperature (ZT) of the plate area (2*a*) is obtained at the bimetal element (7*c*).

3. The electrical radiant heater according to claim 1, wherein said thermal switch (7) sensing element is a bimetal disc (7*c*) to which the radiation from the heating resistor (5) is transmitted by way of a receiver base (7*b*) in said compact body made of a thermal conducting material (7*b*), which is positioned facing and near said portion of the heating resistor (5) separated by a given space (A), and said receiver base (7*b*) has a square edge (7*b*′) extended over the heating resistor (5) at a given height (D) of the insulating base so as to facilitate the transmission of heat towards the bimetal disc (7*c*).

4. The electrical radiant heater according to claim 1, wherein the thermal switch sensing element (7*c*) is conformed as a bimetal plate housed in the compact body (7*a*), in thermal communication with an opening in one end of the sensor compact body (7*a*), and the latter is positioned resting on a surface of the insulating base (4*a*), with said transmission opening facing towards a portion of the heating resistor (5).

5. The electrical radiant heater according to claim 1, wherein said compact body (7*a*) of the thermal switch being engaged on said central surface (4*a*) of the insulating base, and separated from the cooking plate by an electrical insulation space (B), and a connecting terminal of the electrical contact of the sensor switch comprise a rigid cable (9) which is extended towards said peripheral wall (3,6) of the radiant heater, and coupled rigidly to said electrical connector (8), exerting an elastic force (F) that presses said switch body (7*a*) retaining it against said central surface (4*a*) of the insulating base.

* * * * *